US005358292A

United States Patent [19]

Van Wiebe et al.

[11] Patent Number: 5,358,292

[45] Date of Patent: Oct. 25, 1994

[54] GATE LATCH

[76] Inventors: Peter C. Van Wiebe, 211 Queensland Rd. S.E., Calgary, Alberta, Canada, T2J 3S1; Dietmar H. Penno, 3004 Pallister Dr. S.W., Calgary, Alberta, Canada, T2V 4G2

[21] Appl. No.: 105,282

[22] Filed: Jul. 30, 1993

Related U.S. Application Data

[63] Continuation-in-part of Ser. No. 849,773, Mar. 12, 1992, abandoned.

[51] Int. Cl.[5] ..... E05C 3/16

[52] U.S. Cl. ..... 292/235; 292/125; 292/225; 292/DIG. 25

[58] Field of Search ..... 49/354, 355, 356; 292/225, 235, 125, DIG. 14, DIG. 25

[56] References Cited

U.S. PATENT DOCUMENTS

| | | | |
|---|---|---|---|
| 1,669,356 | 5/1928 | Stevenson | 292/DIG. 14 X |
| 2,749,165 | 6/1956 | Coulter | 292/DIG. 14 X |
| 2,809,064 | 10/1957 | Dlugotch | 292/DIG. 14 X |
| 3,433,518 | 3/1969 | Foltz | 292/235 X |
| 3,601,434 | 8/1971 | Fargo | 292/DIG. 14 X |
| 4,917,418 | 4/1990 | Gokee | 292/DIG. 25 X |

*Primary Examiner*—Rodney M. Lindsey
*Attorney, Agent, or Firm*—Jerry T. Kearns

[57] ABSTRACT

A gate latch of the type including a latch bar mounted for movement with a hinged gate and a latch bracket secured to a stationary gate post disposed for engagement with the latch bar when the gate is in a closed position includes an elongated wire cable having a first end secured to a pivotal latch lever mounted in the latch bracket. The pivotal latch lever includes a recess for partially surrounding the latch bar in a latched position. A second end of the cable extends through a bore in the gate post and is secured to an enlarged handle for manual tensioning of the cable to move the pivotal latch lever to an unlatched position. A pair of bushings are disposed in opposite outer end portions of the bore formed through the gate post and include exposed radially extending abutment flanges. A coil compression spring surrounds the elongated cable and includes a first end in abutment with one of the gate post bushings and a second opposite end in abutment with a crimping sleeve securing the cable to the pivotal latch lever. The coil spring biases the latch lever into a latched position. In use, an individual grasps the handle secured to the end of the cable and moves the latch lever to the unlatched position against the bias of the coil spring.

20 Claims, 9 Drawing Sheets

GATE LATCH

CROSS-REFERENCE TO RELATED APPLICATIONS

This is a continuation-in-part of U.S. application Ser. No. 07/849,773 filed Mar. 12, 1992 now abandoned.

BACKGROUND OF THE INVENTION

1. Field of the Invention

The present invention relates to gate latches, and more particularly pertains to gate latches of the type including a latch bar mounted for movement with a hinged gate and disposed for engagement, in a closed position, in a latch bracket secured to a stationary gate post. In this conventional form of gate latch, a latch lever is pivotally mounted in the latch bracket and includes a recess for partially surrounding the latch bar in the closed or latched position. Due to frictional forces inhibiting movement of the pivotal lever, progressively increasing with age, misalignment between the latch bracket and latch bar, and a variety of other factors, frequently the pivotal latch lever of such gate latches does not completely engage and secure the latch bar in a fully latched position. Even when the gate, gate post, and gate latch are all perfectly aligned, as in a newly constructed gate, the gate latch can bounce out of or rebound away from the latch lever when the gate is closed hard or slammed. As a result, the gate is unintentionally left in an open position. This can happen even when the latch lever is down in a receiving position, because there is no downward pressure on the latch lever. Constant downward spring tension pressure prevents the latch bar from bounding out or rebounding when the gate is closed hard or slammed. As gates including this conventional type of latch are frequently used to prevent small children and pets from leaving a particular designated fenced area, there is a substantial danger that failure of the latch can have serious consequences.

2. Description of the Prior Art

The above described form of gate latch is well-known and has been in common use for many years. Previously, it has been proposed to fasten a cord or string to the ned of the pivotal latch lever in order that the latch lever might be manipulated from the opposite side of the gate or fence. However, this conventional mechanism does not exert a restorative force urging the latching lever to the latched position. Accordingly, there is still a substantial danger that the latch lever will not move to the fully latched position upon release of the cord or string, due to the aforementioned frictional and misalignement factors, and also due to a slackness in the cord or string.

SUMMARY OF THE INVENTION

Accordingly, it is an object of the present invention to provide a new and improved gate latch or an accessory for an existing gate latch which includes a mechanism for allowing actuation and release of a gate latch lever from an opposite side of the gate or fence and which provides a restorative spring force which ensures that the pivotal latch lever will always move into a secure latched position surrounding the latch bar.

In order to achieve these and other objects of the invention, the present invention provides an improved gate latch or an accessory for an existing gate latch of the type including a latch bar mounted for movement with a hinged gate and a latch bracket secured to a stationary gate post and disposed for engagement with the latch bar when the gate is in a closed position which includes an elongated wire cable having a first end secured to a pivotal latch lever mounted in the latch bracket. The pivotal latch lever includes a recess for partially surrounding the latch bar in a latched position. A second end of the cable extends through a bore in the gate post and is secured to an enlarged handle for manual tensioning of the cable to move the pivotal latch lever to an unlatched position. A pair of bushings are disposed in opposite outer end portions of the bore formed through the gate post and include exposed radially extending abutment flanges. A coil compression spring surrounds the elongated cable and includes a first end in abutment with the gate post bushing and a second opposite end in abutment with a crimping sleeve securing the cable to the pivotal latch lever. The coil spring biases the latch lever into a latched position. In use, an individual grasps the handle secured to the end of the cable and moves the latch lever to the unlatched position against the bias of the coil spring.

In a second embodiment of the invention, latch clip including hinged leg portions is molded on the end of a nylon actuating cable for securing the cable to the latch lever. A pin on one of the clip legs is inserted through an aperture in the latch lever and lockingly engaged with the other clip leg. The cable includes a toothed opposite end portion adjustably engageable with a complementary toothed split wedge collet for securing a handle in a selected adjusted position along the cable.

These and various other advantages and features of novelty which characterize the invention are pointed out with particularlity in the claims annexed hereto and forming a part hereof. However, for a better understanding of the invention, its advantages, and the object obtained by its use, reference should be made to the drawings which form a further part hereof, and to the accompanying descriptive matter, in which there is illustrated and described preferred embodiments of the invention.

DETAILED DESCRIPTION OF THE PREFERRED EMBODIMENT(S)

Figure 1:
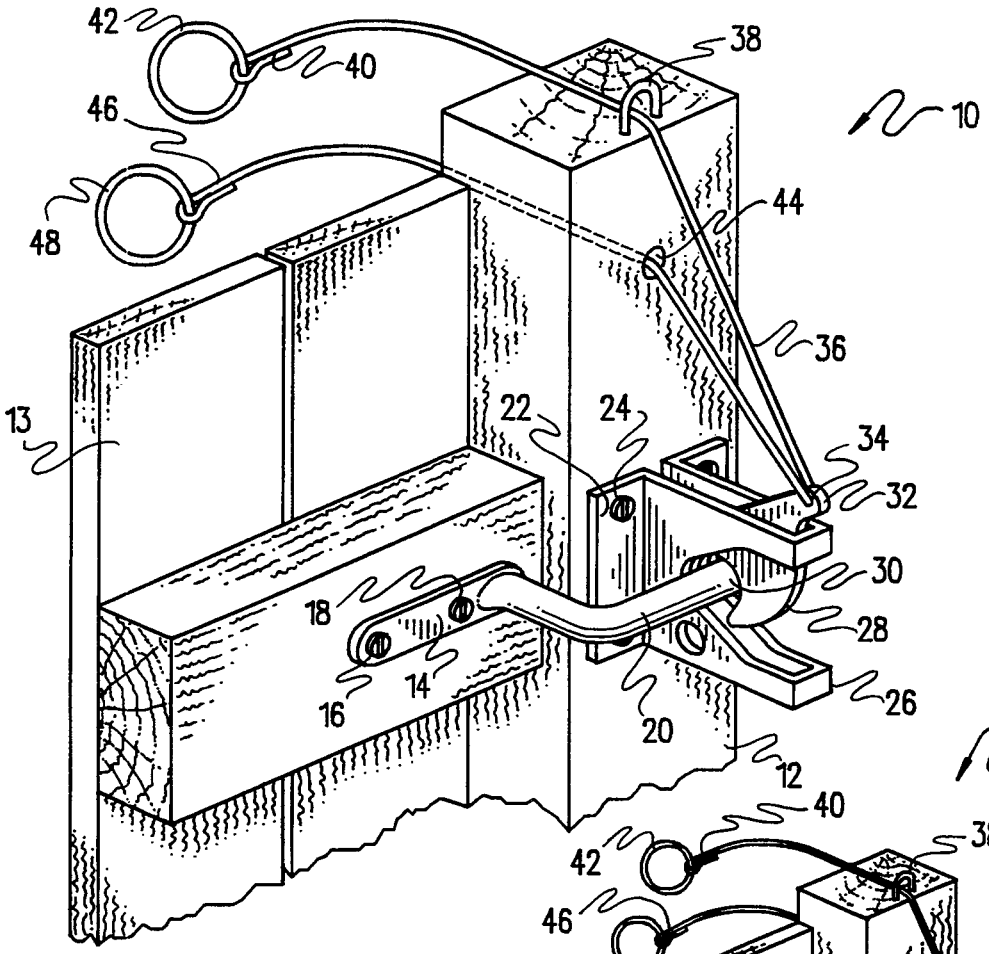
Fig. 1 (PRIOR ART)
FIG. 1 is a partial perspective detail view illustrating the conventional type of gate latch to which the present invention is directed.
Figure 2:
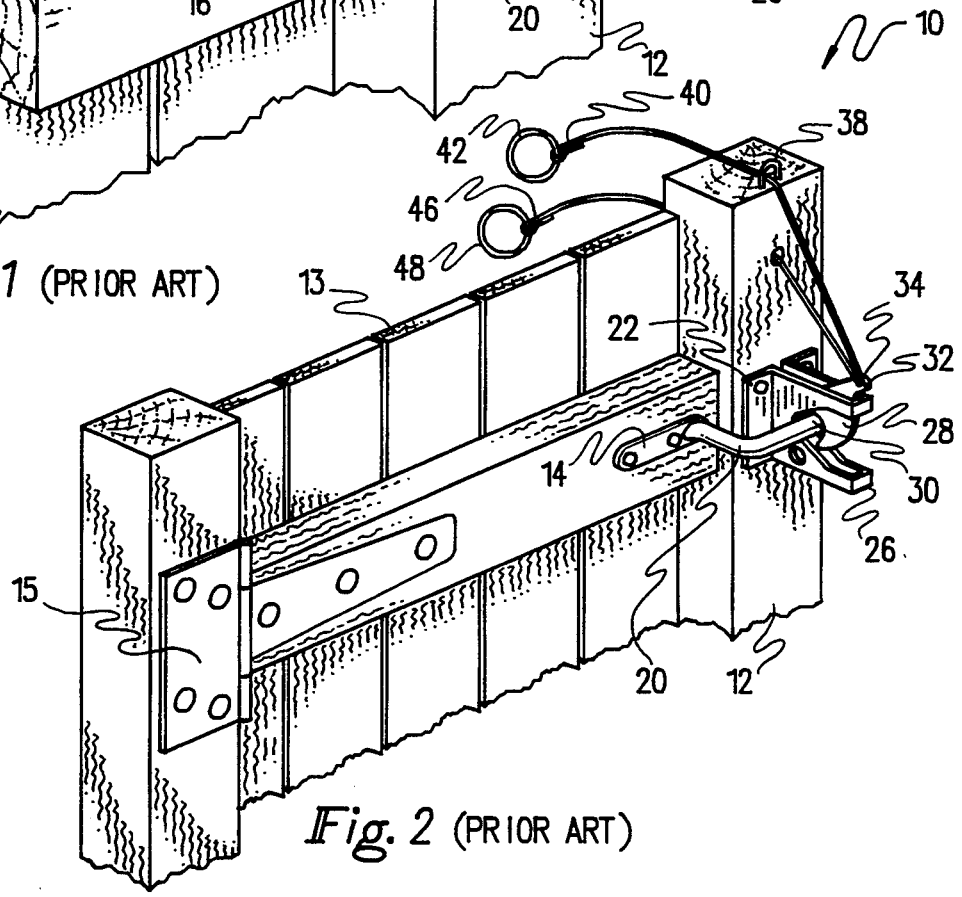
Fig. 2 (PRIOR ART)
FIG. 2 is a perspective view further illustrating a hinged gate provided with the conventional form of gate latch illustrated in FIG. 1.

Referring now to the drawings, wherein like reference numerals designate corresponding structure throughout the views, and referring in particular to FIGS. 1 and 2, the conventional form of gate latch 10 to which the present invention is directed, will now be described. The conventional form of gate latch is typically employed in connection with a stationary gate post 12 mounted adjacent the free edge of a hinged gate 13. The gate 13 is typically secured to an additional stationary fence post by a hinge 15. A latch bar mounting plate 14 is secured to the gate 13 by a pair of conventional wood screws 16 and 18. The latch bar 20 typically includes a right angle bend portion such that the latch bar 20 is disposed in alignment for engagement in a latch bracket 26 secured to the stationary gate post 12 by a mounting bracket 22 and a plurality of conventional wood screws 24. Alternatively, the bracket 26 may be secured to the gate 13 and the latch bar 20 mounted on the post 12 without altering the salient function of the components. A pivotal latch lever 28 includes a recess 30 which partially surrounds the latch bar 20 in the latched positioned illustrated in FIGS. 1 and 2. An outermost free end portion 32 of the pivotal latch lever 28 is provided with an aperture 34 through which a string or cord 36 extends. A first end of the string or cord 36 is received through a staple 38 driven into the top end face of the gate post 12. The first end of the string 36 is secured by a knot or loop at 40 to an enlarged ring 42. A second opposite end of the string or cord 36 is secured by a loop or knot fastener 46 to a second enlarged ring 48. Thus, it is contemplated that by pulling one or both of the rings 42 and 48, the pivotal latch lever 28 may be moved to an unlatched position by an individual disposed on the opposite side of the gate 13. However, this remote latch actuating mechanism does not provide a constant downward pressure on the latch lever 28 to stop the latch bar 20 from bouncing out when the gate is closed or slammed. Thus, upon release of the rings 42 and/or 48, only gravity causes the pivotal latch lever 28 to move to the latched position. Accordingly, there is a substantial chance that due to frictional forces in the pivotal mounting of the latch lever 28, or friction of the string 36 and the staple 38 or bore 44, or the opposing counterweight forces exerted by the rings 42 and 48, that the pivotal latch lever 28 will not in fact move to a fully latched position. Even if the latch lever 28 moves down to the fully latched position, the latch bar 20 can still bounce out in the absence of weight or downward tension on the latch lever 28. As such conventional gate latches 10 are frequently employed in fences enclosing yards of residential dwellings, there is a substantial chance that such failure of the latch lever 28 to move into the fully latched position can have serious consequences such as the release of small children or pets into streets with heavy traffic. Accordingly, it can be appreciated that it is desirable to provide this conventional and extremely widely utilized form of gate latch with an accessory for positively urging the pivotal latch lever 28 into a fully latched position and for ensuring that the latch bar 20 does not bounce out.

Figure 3:
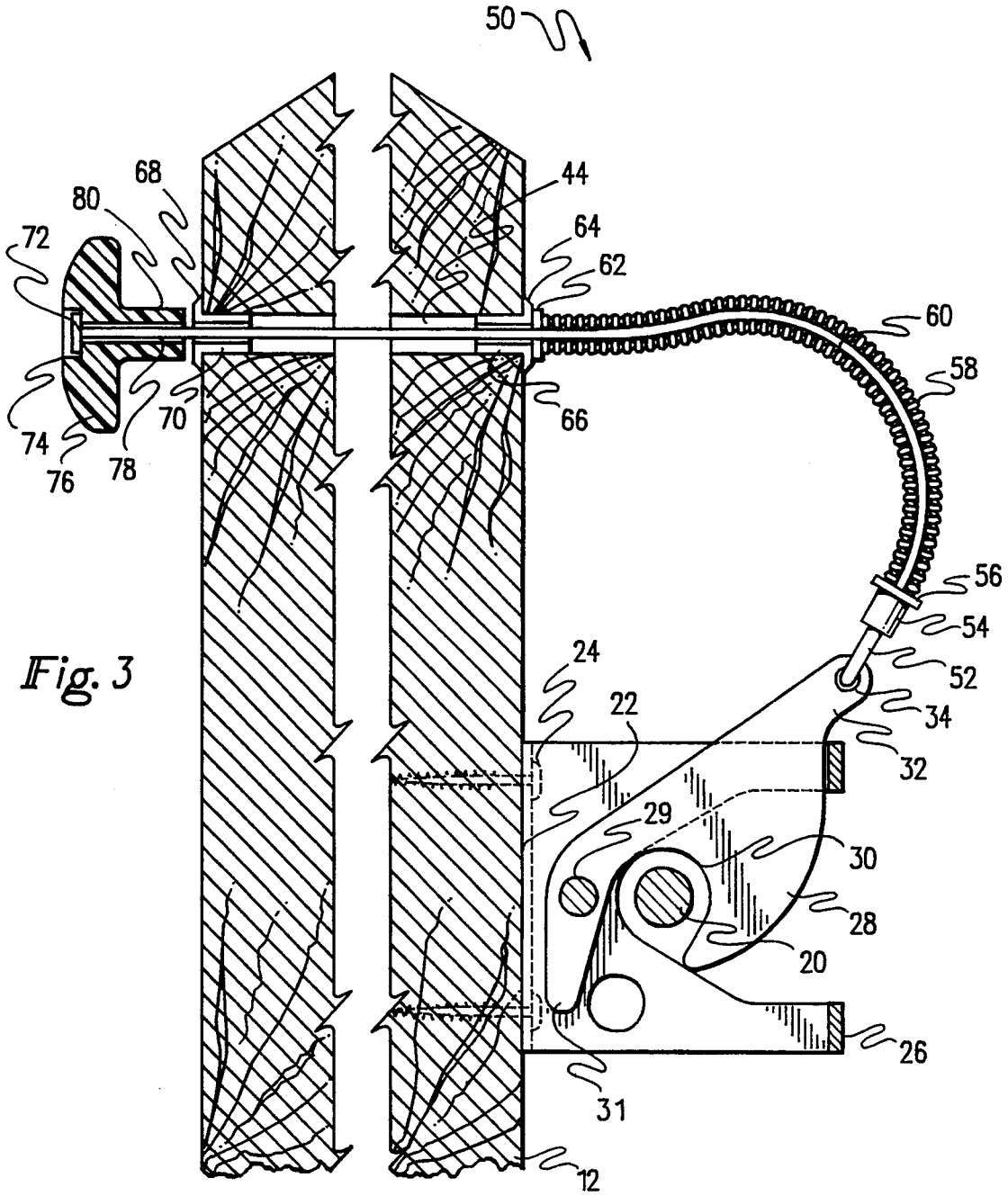
FIG. 3 is a longitudinal cross-sectional view illustrating the gate latch according to a first embodiment of the present invention disposed in a latched position.
Figure 4:
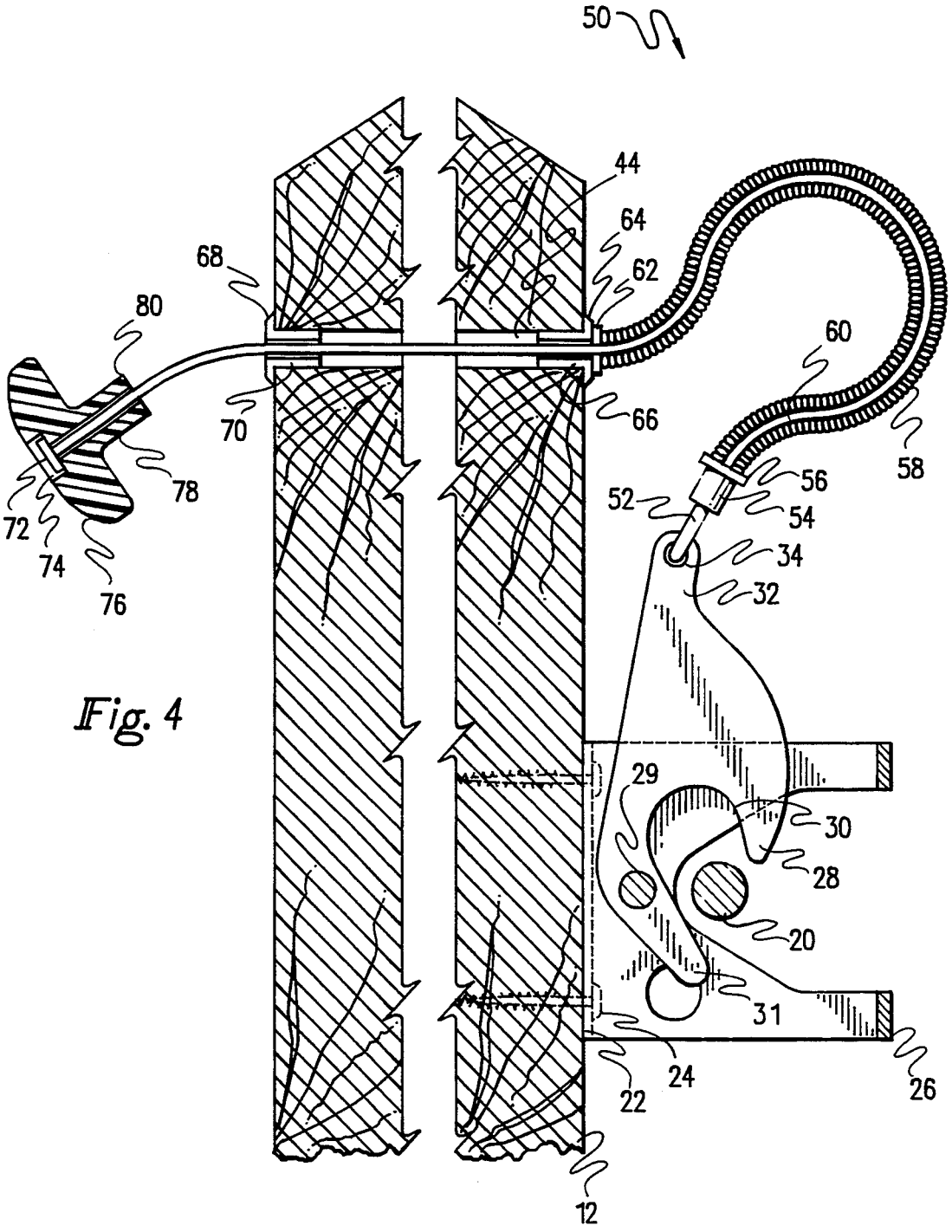
FIG. 4 is a longitudinal cross-sectional view illustrating the gate latch according to the first embodiment of the present invention disposed in an unlatched position.

Accordingly, with reference to FIGS. 3 and 4, a gate latch 50 according to the present invention is adapted for use with the previously described conventional form of gate latch which includes a pivotal latch lever 28 possessing a tang end portion 31 through which a transverse pivot pin 29 is disposed. Accordingly, it can be appreciated that the pivotal latch lever 28 is mounted for limited reciprocal pivotal movement about the central longitudinal axis of the pivot pin 29. In FIG. 3, the latch lever 28 is disposed in a fully latched position, in which the transverse latch bar 20 is partially surrounded within the recess 30 of the pivotal latch lever 28. A wire rope or cable 60 has a first end secured to the outer end portion 32 of the latch lever 28. Preferably, the cable 60 extends through the aperture 34 in the form of a loop which is then secured by a crimping sleeve 54. The sleeve 54 may be formed from aluminum so as to be easily crimped to secure the wire loop 52, and also includes a radially extending abutment flange 56. The wire cable 60 passes through the interior of a coil compression spring 58 and subsequently through a bore 44 formed through the gate post 12. A pair of bushings 66 and 70 are identically formed and each include respective oppositely directed radial abutment flanges 64 and 68. A washer 62 is secured to one end face of the coil compression spring 58 and is disposed in abutment with the flange 64 on the bushing 66. The opposite end of the coil compression spring 58 is disposed in abutment with the flange 56 of the crimping sleeve 54. Accordingly, the coil spring 58 biases the crimping sleeve 54 and attached end portion 32 of the latch lever 28 away from the post 12. The free end of the wire rope or cable 60 extends through bushing 66, through bore 44, through bushing 70, and through a stem portion 78 of a plastic handle 76. An enlarged terminal end 72 is secured, for example by crimping, on the free end portion of the wire rope or cable 60. The enlarged end 72 is received within an axially outwardly directed recess 74 in the outer end face of the handle 76.

The coil spring 58 preferably is formed from 0.040 inch diameter music wire with a 0.130 inch wide diameter, 75 total coils, and a free length at 4.370 inches. In the latched position illustrated in FIG. 3, the coil spring 58 is preferably disposed in a slightly compressed condition such that the pivotal latch lever 28 is biased firmly to the illustrated latched position.

When it is desired to move the latch lever 28 to the unlatched position illustrated in FIG. 4, an individual grasps the handle 76 and exerts a tensional force on the wire cable 60 against the bias of the spring 58. Accordingly, the coils of the spring 58 are urged together and the axial length of the spring 58 is reduced. Upon subsequent release of the handle 76, the spring 58 urges the pivotal latch lever 28 securely into the latched position illustrated in FIG. 3.

With reference to FIGS. 5 through 22, a gate latch 100 according to a second embodiment of the present invention will not be described. Essentially identical components have been designated by the reference numerals employed previously, while slightly modified but equivalent components have been designated by the reference numerals previously employed, in conjunction with a prime symbol (').

Figure 5:
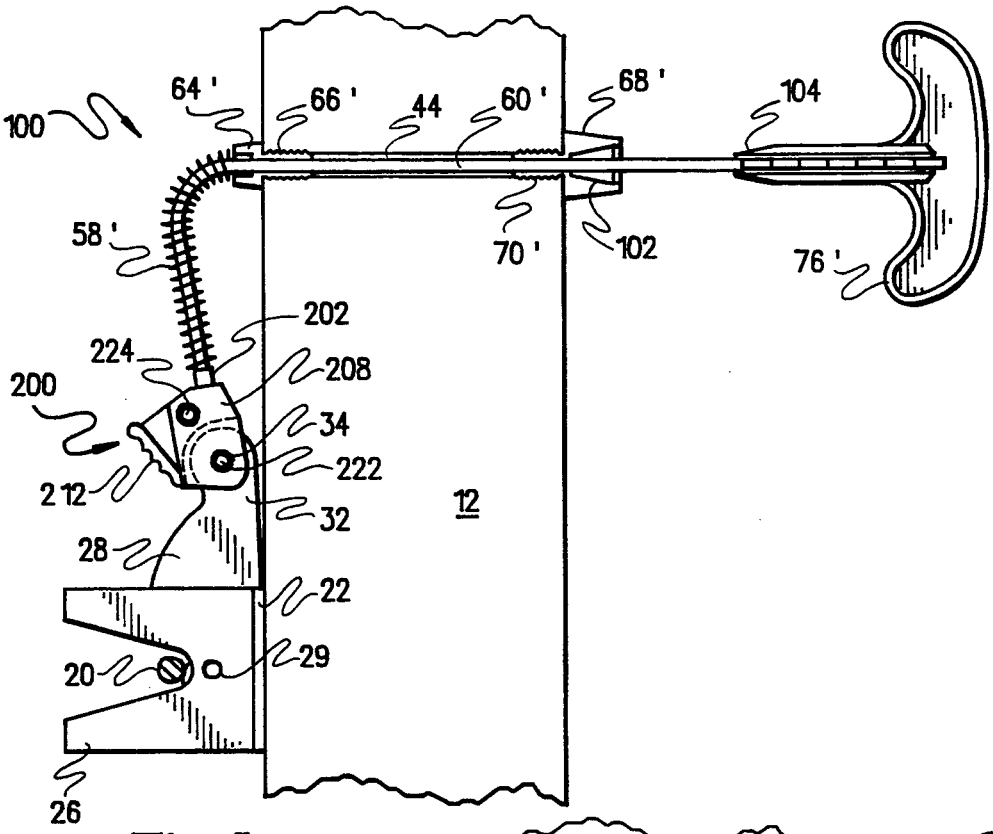
FIG. 5 is a longitudinal cross-sectional view illustrating the gate latch according to a second embodiment of the present invention disposed in an unlatched position.
Figure 6:
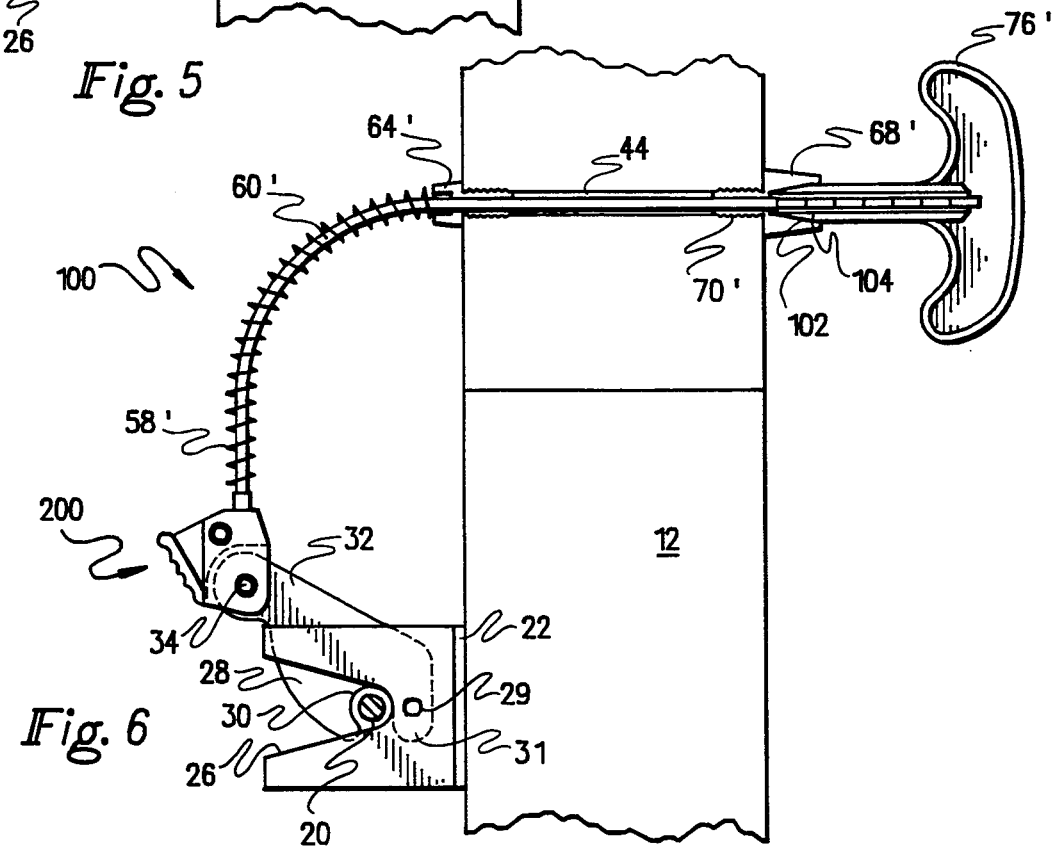
FIG. 6 is a longitudinal cross-sectional view illustrating the gate latch according to the second embodiment of the present invention disposed in a latched position.
Figure 7:
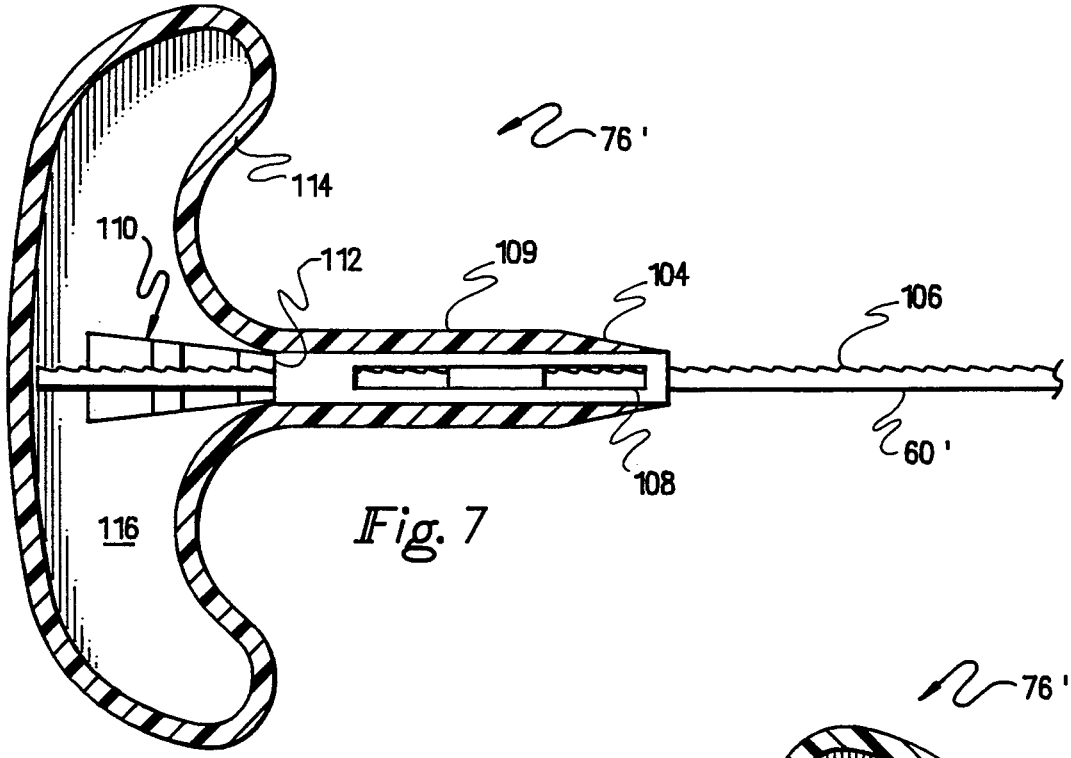
FIG. 7 is a right side elevational view illustrating a handle portion of the gate latch according to the second embodiment of the present invention.
Figure 8:
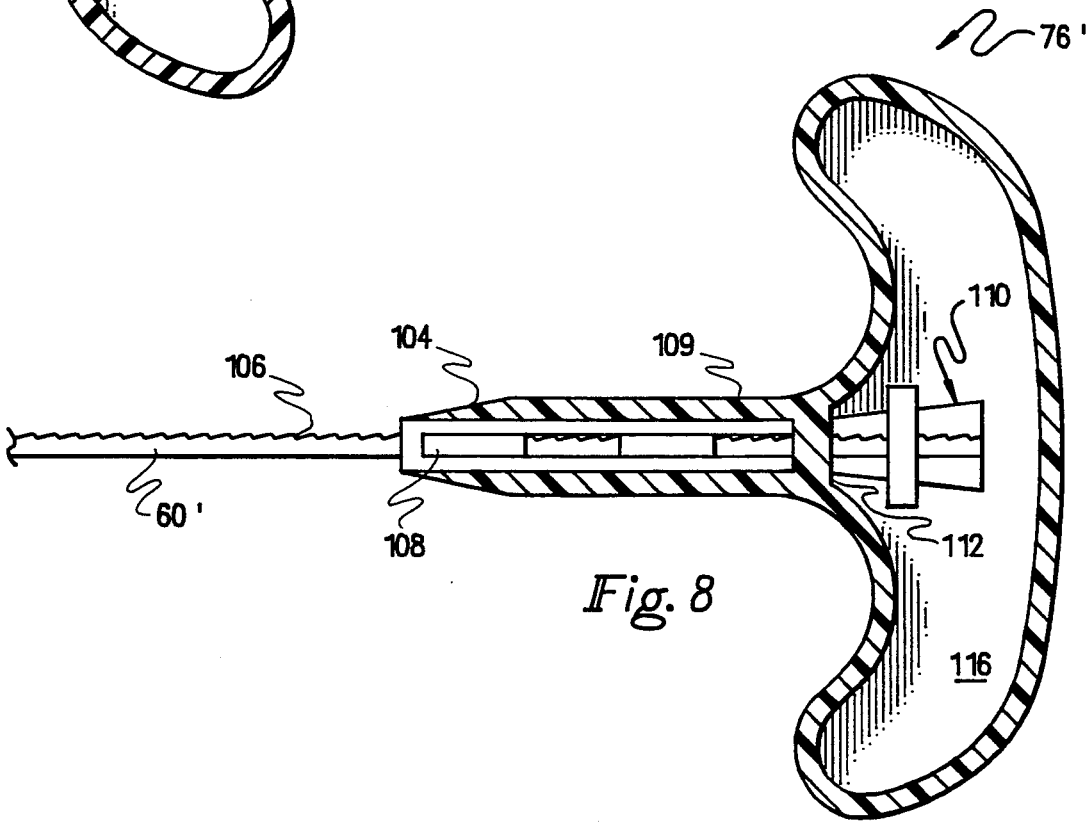
FIG. 8 is a left side elevational view illustrating the handle portion of FIG. 7.
Figure 9:
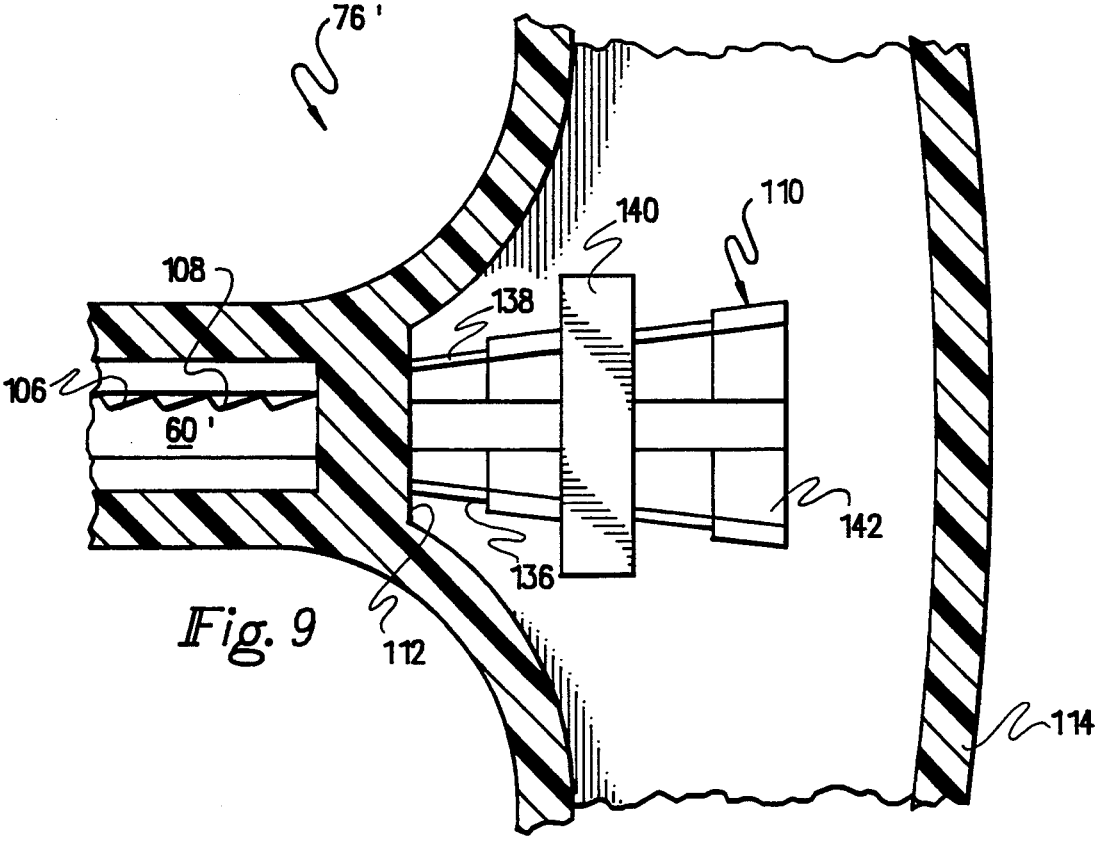
FIG. 9 is an enlarged partial left side detail elevational view illustrating the handle portion of FIG. 7.
Figure 10:
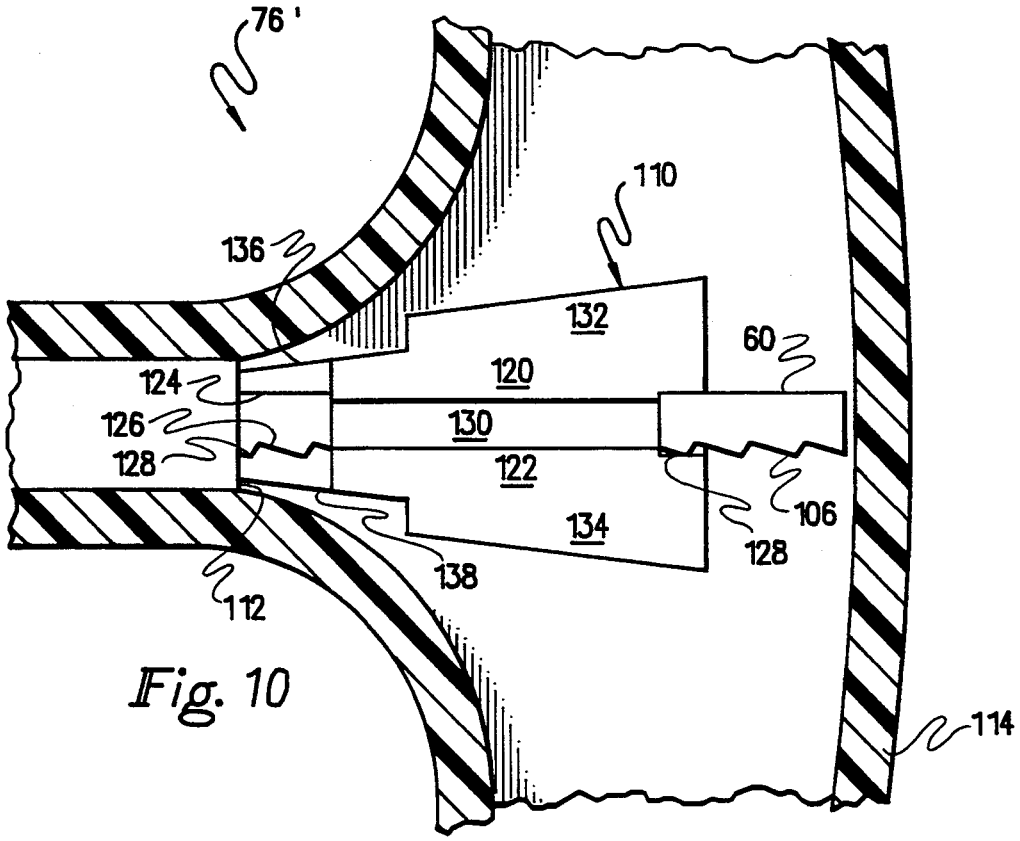
FIG. 10 is an enlarged partial right side detail elevational view illustrating the handle portion of FIG. 7.
Figure 14:
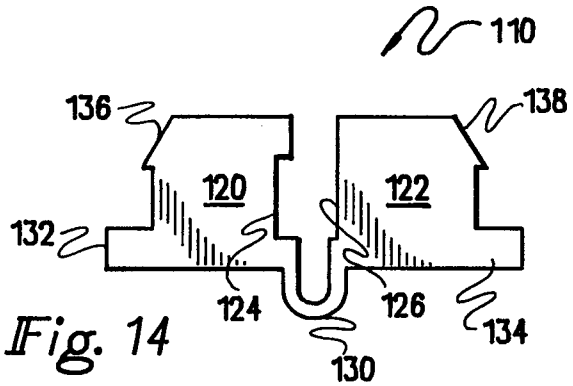
FIG. 14 is a rear elevational view of the collet relative to the orientation as depicted in FIG. 13.
Figure 15:
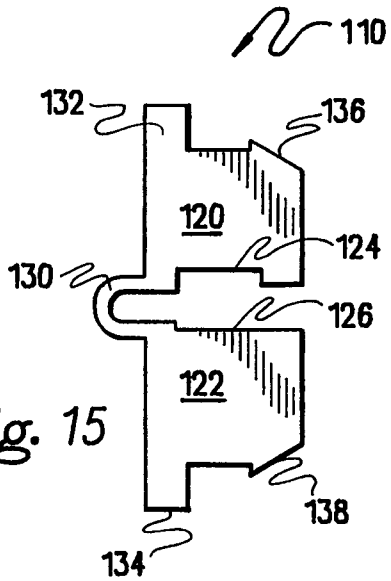
FIG. 15 is a rear elevational view of the collet of FIG. 11.
Figure 13:
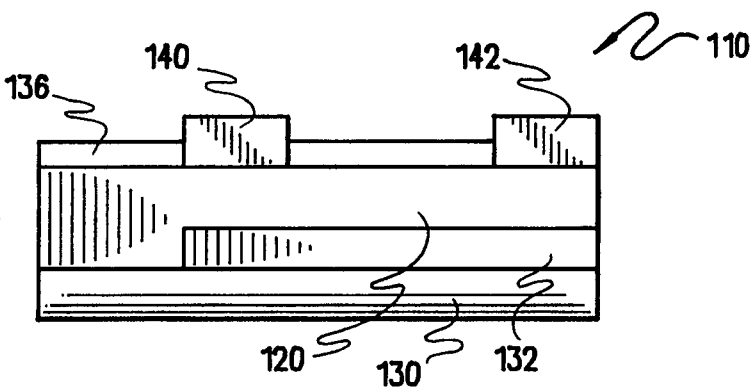
FIG. 13 is a side elevational view of the collet of FIG. 11.
Figure 11:
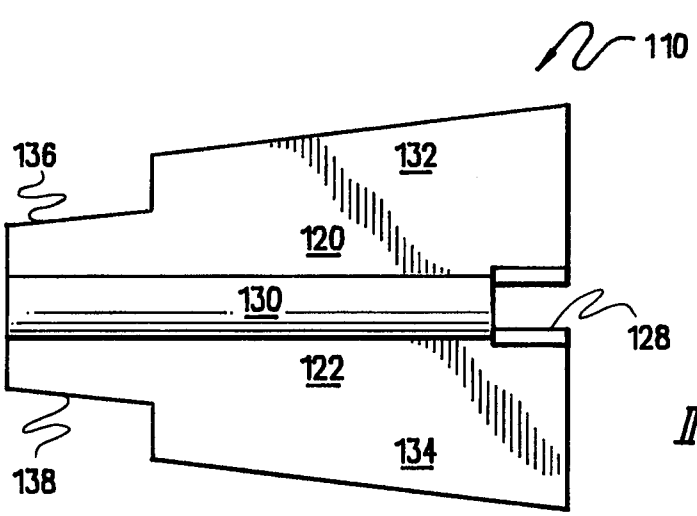
FIG. 11 is a top plan view of a collet for securing the nylon actuating cable of the gate latch according to the second embodiment of the present invention to the handle portion.
Figure 12:
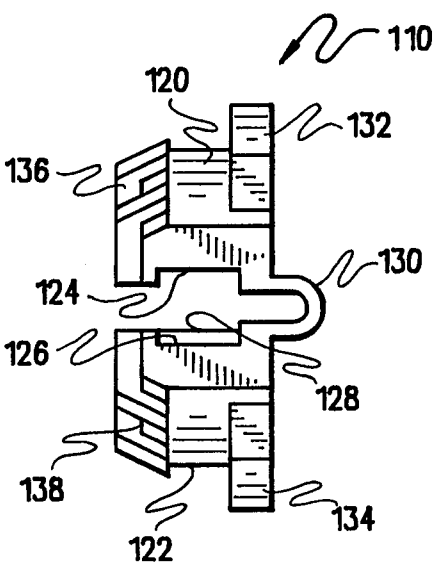
FIG. 12 is a front elevational view of the collet of FIG. 11.
Figure 19:
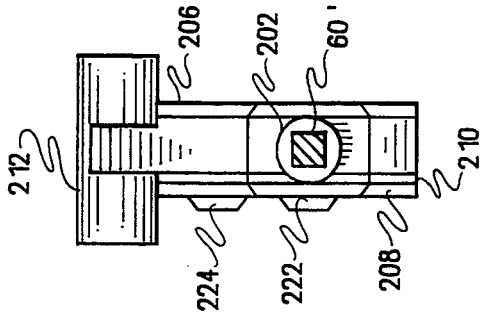
FIG. 19 is a rear elevational view of the latch clip of FIG. 16.
Figure 20:
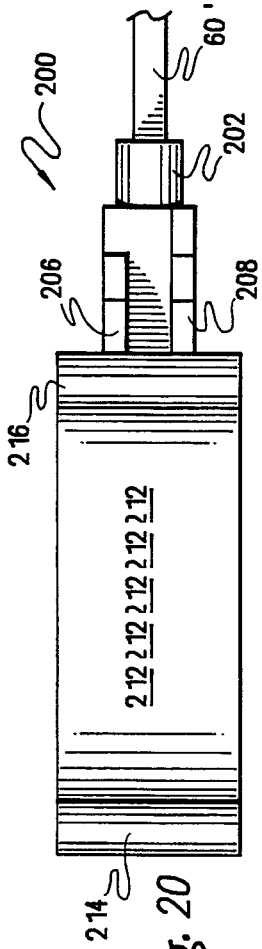
FIG. 20 is a top plan view of the latch clip of FIG. 16.
Figure 16:
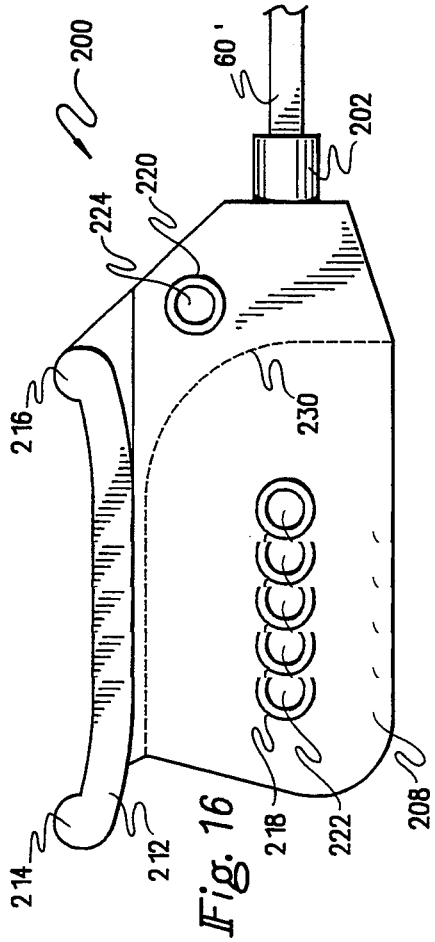
FIG. 16 is a side elevational view of a latch clip portion of the gate latch according to the second embodiment of the present invention for securing the actuating cable to a conventional latch lever.

With particular attention to FIGS. 5 and 6, the gate latch 100 according to the present invention includes a nylon cable 60' with a molded nylon latch clip 200 attached. The latch clip 200 is pivotally connected to the outer end portion 32 of the latch lever 28. The latch lever 28 is actuated by manual manipulation of a handle 76' to tension the cable 60' against the bias of a coil spring 58'. Upon release of the handle 76', the spring 58' restores the assembly to the latched condition shown in FIG. 6. The coil spring 58 preferably is formed from 0.040 inch diameter music nylon with a 0.130 inch wide diameter, 75 total coils, and a free length at 3.75 inches. In the latched position illustrated in FIG. 3, the coil spring 58 is preferably disposed in a slightly compressed condition such that the pivotal latch lever 28 is biased firmly to the illustrated latched position.

A small bushing 66' is inserted in the latch side of a bore 44 in the post 12, such that a radial spring abutment flange 64' is outwardly exposed. Another bushing 70' is inserted in the handle side of the bore 44, such that an exposed abutment portion 68' having a central recess with a frusto conical inner end portion is disposed for engagement with a complementary tapered end portion 104 of the handle 76', when the gate latch 100 is in the latched condition shown in FIG. 6. The nylon cable 60' passes through the interior of the coil compression spring 58' and subsequently through the bore 44. The free end of the nylon cable 60' remote from the latch clip 200 extends through bushing 66', bore 44', bushing 70', and through a guide way 108 (FIGS. 7 through 10) of a nylon handle 76'.

Figure 21:
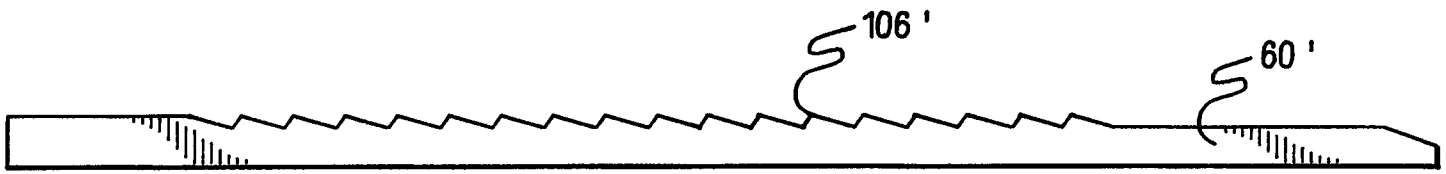
FIG. 21 is a side elevational view of a toothed end portion of the actuating cable of the gate latch according to the second embodiment of the present invention.
Figure 22:
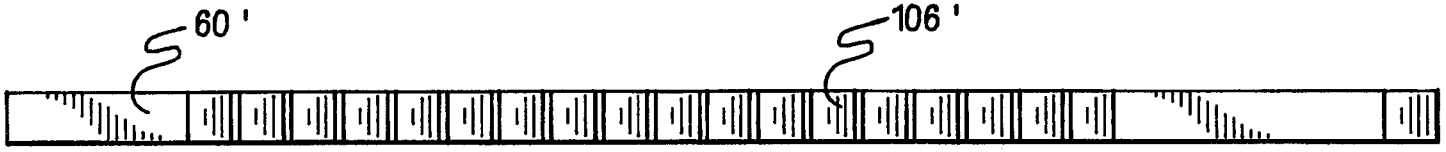
FIG. 22 is a top plan view of the latch cable of FIG. 21.

With reference to FIGS. 21 and 22, the end portion of the nylon cable 60' secured to the handle 76' has a substantially square transverse cross-sectional shape and includes inclined teeth 106 formed on top. With reference to FIGS. 7 through 10, the handle 76' has a guide way 108 formed through the center of an elongated body portion 109 to receive the toothed end portion of the cable 60'. As can be appreciated with reference to FIGS. 9 through 15, a split wedge shaped collet 110 secures the toothed end of the cable 60' to the handle 76'. The collet 110 includes body portions 120 and 122 connected by a resilient longitudinal hinge or bight portion 130. Body portions 122 and 124 include juxtaposed semi-channel portions 124 and 126 dimensioned for engagement with the cable 60'. The semi-channel portion 126 includes teeth 128 dimensioned for engagement with the teeth 106 of the cable 60'. Forward tapered end portions 136 and 18 of the collet 110 are dimensioned for insertion into a recess 112 formed in the handle body portion 109 in alignment with the cable guide way 108. Prior to such insertion, the body portions 120 and 122 of the collet 110 must be manually squeezed together by the exertion of inward pressure on flanges 132 and 134, thus engaging teeth 128 on the collet 110 with the teeth 106 on the cable 60'. After the collet 110 is wedged within handle recess 112, clips 140 and 142 are snapped over undercut wedge portions 136 and 138 to prevent the collet portions 120 and 122 from separating and releasing cable 60'. As can now be appreciated, this arrangement allows the handle position to be readily adjusted along the cable 60' without the need for any tools. The optimum handle position is reached when the spring 58' is resting slightly tensioned between the latch clip 200 and the abutment flange 64' of the inside bushing 66', with the tapered handle stem 104 resting firmly inside the recess 102 of the outer bushing 70'.

A variety of other mechanisms may also be employed to secure the cable 60' to the handle 76' within the scope of the present invention. For example, a set screw may be used to secure the cable in a selected adjusted position within the handle. Or teeth may be provided within the handle guide way to engage the teeth on the cable, with or without a set screw. The handle guide way might also include a labyrinth path, such that the toothed cable is wrapped around one or more complementary toothed capstan members within the guide way.

Figure 18:
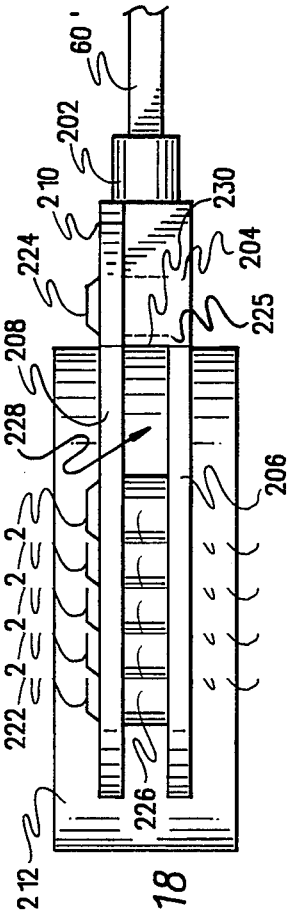
FIG. 18 is a bottom plan view of the latch clip of FIG. 16.
Figure 17:
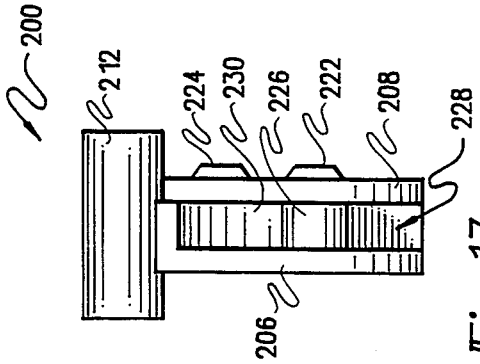
FIG. 17 is a front elevational view of the latch clip of FIG. 16.

With reference to FIGS. 5, 6, 16 through 20, the molded nylon latch clip 200 for pivotally securing the end of the cable 60' remote from the handle 76' to the latch lever 28 includes a coupling sleeve 202 molded or otherwise secured on the end of the cable 60'. The coupling sleeve 202 is integrally molded with a body portion 204 including a first leg 206. A second leg 208 is connected to the body portion 204 by a flexible hinge 210, for example consisting of a reduced thickness portion of the integrally molded article, such that the leg 208 is moveable into parallel alignment with the leg 206, as best seen in FIGS. 17 and 18. A pair of parallel retaining pins 226 and 225 extending transversely from leg 206 and body portion 205 include respective tapered free end portions 222 and 224 dimensioned for locking engagement within holes 218 and 220 formed in leg 208. Accordingly, to attach the clip 200 to the latch lever 28, the pin 226 is first inserted through the hole 34 in the end portion 32 of the latch lever 28, and then the hinged initially separated legs 206 and 208 are squeezed together until tapered end portions 222 and 224 of pins 226 and 225 lock into holes 218 and 220. The clip 200 is then pivotally mounted about the axis of pin 226, with the end portion 32 of the latch lever 28 captured within the space 228 formed between the legs 206 and 228 and bounded by an arcuate inner surface 230 of the body 204. A knob portion 212 on the clip 200 includes spaced rounded protuberances 214 and 216 to facilitate manual operation of the latch lever 28 by an individual located inside the gate.

When it is desired to move the latch lever 28 to the unlatched position illustrated in FIG. 5, an individual grasps the handle 76' and exerts a tensional force on the nylon cable 60' against the bias of the spring 58'. Accordingly, the coils of the spring 58' are urged together and the axial length of the spring 58' is reduced. Upon subsequent release of the handle 76', the spring 58' urges the pivotal latch lever 28' securely into the latched position illustrated in FIG. 6.

Accordingly, it can be appreciated that the present invention provides a simple and inexpensive latching accessory item which can be either sold in conjunction with or as an accessory attachment to the common and widely utilized pivotal gate latch.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. In combination with a gate latch including a hinged gate and a stationary gate post, a latch bar mounted on one of said gate and said post, a latch bracket secured on the other of said gate and said post disposed for receiving the latch bar when the gate is in a closed position, a latch lever pivotally mounted to the latch bracket and including a recess dimensioned for partially surrounding the latch bar in a latched position, an accessory gate latch actuating mechanism comprising:

an elongated cord member including first and second opposite ends;

a clip member securing said first end of said cord member to said latch lever, said clip member including two hinged body portions dimensioned to capture said latch lever therebetween and said clip member including retaining means for retaining said two hinged body portions together and in engagement with said latch lever;

a coil spring surrounding said cord member, said coil spring including a first end portion abutting said clip member and biasing said latch lever to a latched position; and grasping means for grasping by an individual secured to said second end of said cord member for selectively moving said latch lever between latched and unlatched positions.

2. The combination of claim 1, wherein said retaining means comprises a retaining pin on one of said body portions dimensioned for insertion through an aperture in an end portion of said latch lever and for locking engagement with the other of said body portions for pivotally securing said clip member to said latch lever.

3. The combination of claim 1, wherein said clip member includes a knob portion for manual manipulation by an individual on an inner side of said gate.

4. The combination of claim 3, wherein said knob portion includes spaced rounded protuberances.

5. The combination of claim 1, wherein said cord member comprises a nylon cable.

6. The combination of claim 1, wherein said grasping means comprises a handle.

7. The combination of claim 6, wherein said cord member comprises a cable possessing teeth on said second end and said handle includes means for selectively engaging at least one of said teeth for securing said handle in an adjusted position along said cable.

8. The combination of claim 7, wherein said means for selectively engaging comprises a split collet including at least one tooth for engaging at least one tooth on said cable.

9. The combination of claim 8, wherein said cable extends through an internal guide way in said handle and said collet includes a tapered end portion dimensioned for engagement in an outwardly opening recess communicating with said guide way.

10. The combination of claim 1, further comprising an aperture formed through said gate post, a bushing in said aperture including an exposed radial flange, said cord member extending through said bushing, and said coil compression spring having a second end in abutment with said radial flange.

11. In combination with a gate latch including a hinged gate and a stationary gate post, a latch bar mounted on one of said gate and said post, a latch bracket secured on the other of said gate and said post disposed for receiving the latch bar when the gate is in a closed position, a latch lever pivotally mounted to the latch bracket and including a recess dimensioned for partially surrounding the latch bar in a latched position, an accessory gate latch mechanism comprising:

an elongated cable possessing a first end secured to said latch lever and a second end adapted for grasping by an individual for selectively moving said latch lever between latched and unlatched positions, said cable possessing teeth on said second end;

spring means for biasing said latch lever to a latched position; and a handle for grasping by an individual secured to said second end of said cable for selectively moving said latch lever between latched and unlatched positions, said handle including means for selectively engaging at least one of said teeth on said cable for securing said handle in an adjusted position along said cable.

12. The combination of claim 11, wherein said means for selectively engaging comprises a split collet having at least one tooth for engaging at least one tooth on said cable.

13. The combination of claim 12, wherein said cable extends through an internal guide way in said handle and said collet includes a tapered end portion dimensioned for engagement in an outwardly opening recess communicating with said guide way.

14. The combination of claim 11, further comprising a clip member securing said first end of said cable to said latch lever, said clip member including two hinged body portions dimensioned to capture said latch lever therebetween and said clip member including retaining means for retaining said two hinged body portions together and in engagement with said latch lever.

15. The combination of claim 14, wherein said retaining means comprises a retaining pin on one of said body portions dimensioned for insertion through an aperture in an end portion of said latch lever and for locking engagement with the other of said body portions for pivotally securing said clip member to said latch lever.

16. The combination of claim 14, wherein said clip member includes a knob portion for manual manipulation by an individual on an inner side of said gate.

17. The combination of claim 16, wherein said knob portion includes spaced rounded protuberances.

18. The combination of claim 11, wherein said spring means comprises a coil spring surrounding said cable and having a first end biasing said latch lever to said latched position.

19. The combination of claim 18, further comprising an aperture formed through said gate post, a bushing in said aperture including an exposed radial flange, said cable extending through said bushing, and said coil compression spring having a second end in abutment with said radial flange.

20. In combination with a gate latch including a hinged gate and a stationary gate post, a latch bar mounted on one of said gate and said post, a latch bracket secured on the other of said gate and said post disposed for receiving the latch bar when the gate is in a closed position, a latch lever pivotally mounted to the latch bracket and including a recess dimensioned for partially surrounding the latch bar in a latched position, an accessory gate latch actuating mechanism comprising:

an elongated cord member having a first end secured to said latch lever and a second end including means for grasping by an individual for selectively moving said latch lever between latched and unlatched positions;

an aperture formed through said gate post;

a bushing disposed in said aperture and including an exposed radial flange;

a coil compression spring having a first end disposed in abutment with said radial flange of said bushing and a second end disposed for exerting an opposite force on said latch lever and biasing said latch lever to a latched position; and said cord member extending through said coil compression spring and through said bushing for allowing actuation of said latch lever by an individual disposed on a side of said gate opposite from said gate latch.

* * * * *